US007323066B1

(12) United States Patent
Budron

(10) Patent No.: US 7,323,066 B1
(45) Date of Patent: Jan. 29, 2008

(54) PAINT ACCESSORY CLEANING DEVICE AND METHOD

(76) Inventor: Collin Budron, 7077 Garden Prairie Rd., Garden Prairie, IL (US) 61038

( * ) Notice: Subject to any disclaimer, the term of this patent is extended or adjusted under 35 U.S.C. 154(b) by 582 days.

(21) Appl. No.: 10/864,589

(22) Filed: Jun. 9, 2004

Related U.S. Application Data

(63) Continuation-in-part of application No. 10/603,479, filed on Jun. 25, 2003, now abandoned.

(51) Int. Cl.
*B08B 3/00* (2006.01)
*B08B 7/00* (2006.01)
*C23D 17/00* (2006.01)
*D06F 3/00* (2006.01)

(52) U.S. Cl. ..... 134/38; 68/213; 134/103.2; 134/117; 134/138; 134/143; 134/148; 134/149

(58) Field of Classification Search ..... 68/213
See application file for complete search history.

(56) References Cited

U.S. PATENT DOCUMENTS 3,421,527 A * 1/1969 Dettman ..... 134/138
4,380,478 A * 4/1983 Cooney ..... 134/38
5,086,796 A * 2/1992 Bailey ..... 134/182
5,932,028 A * 8/1999 Carrie et al. ..... 134/32

* cited by examiner

*Primary Examiner*—Michael Barr
*Assistant Examiner*—Rita R Patel
(74) *Attorney, Agent, or Firm*—Kajane McManus

(57) ABSTRACT

A device and method for cleaning paint accessories and particularly roller covers and/or other paint accessories simultaneously or individually. A spray head has a fluid inlet engageable to a source of fluid and a fluid collection chamber in communication with the fluid inlet. A plurality of spray apertures are radially spaced within the spray head to be adjacent the nap of a roller cover during use. A sealing surface positioned within the radius of the spray apertures seals off an end of the roller cover. A housing having an inner cavity for receiving a roller cover has a diameter sized to create cleansing fluid flow through the nap of a roller cover. A plurality of outlet apertures in communication with the inner cavity are radially spaced to be adjacent a nap portion of a roller cover during use. A plurality of decreased diameter nestable sleeves adapted to fit in the housing are also provided to accommodate variously circumferentially dimensioned paint rollers.

3 Claims, 4 Drawing Sheets

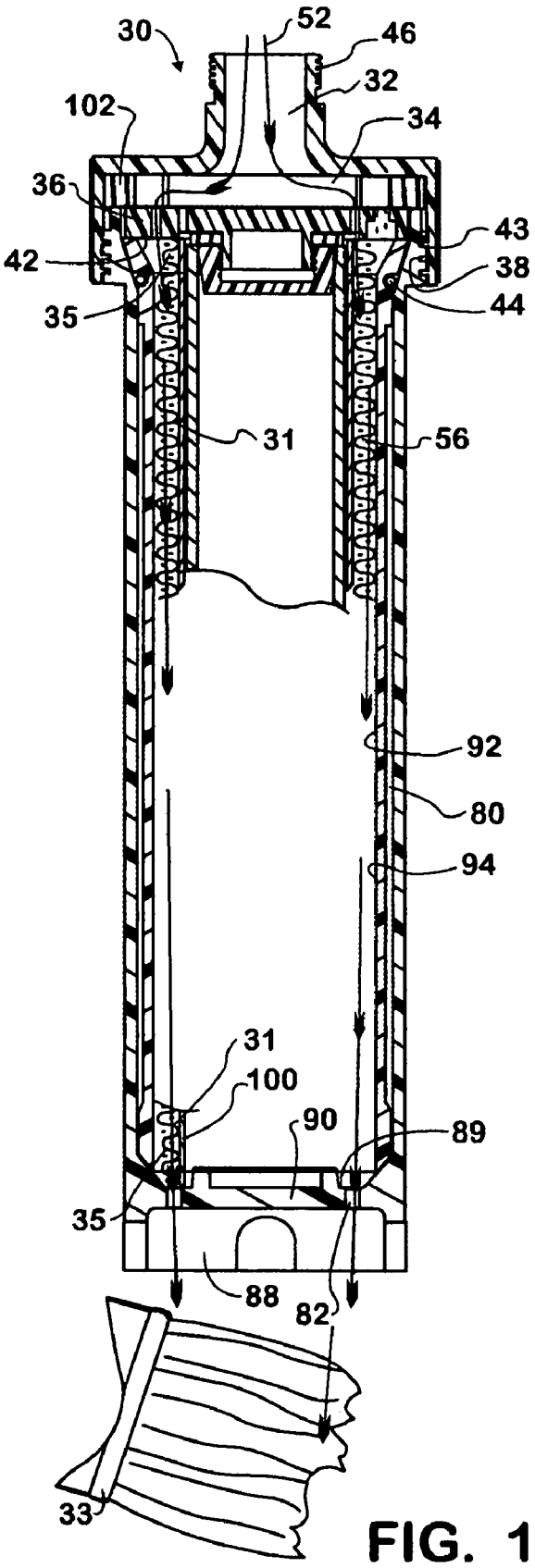
FIG. 1
FIG. 11
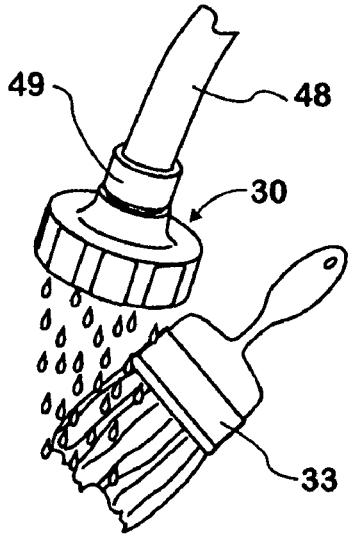

FIG. 2
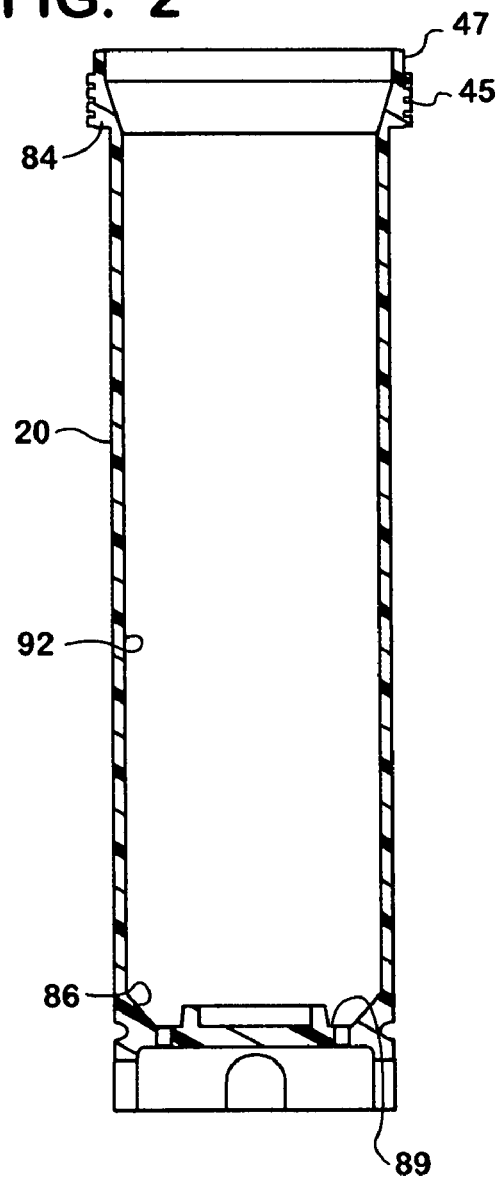
FIG. 4
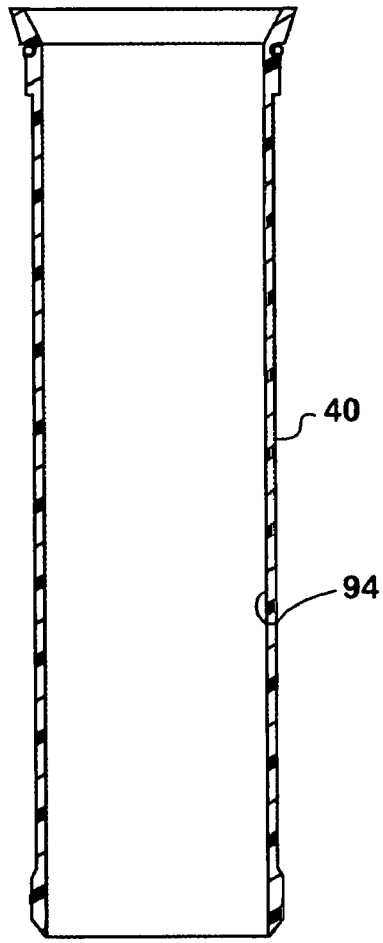
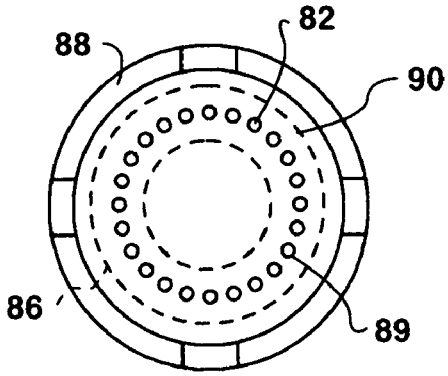
FIG. 3
FIG. 5
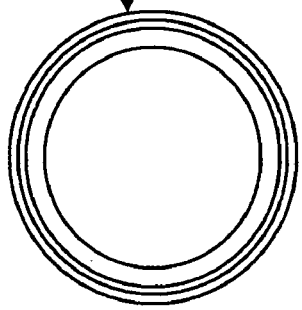

PAINT ACCESSORY CLEANING DEVICE AND METHOD

CROSS REFERENCE TO RELATED APPLICATIONS

This application is a continuation in part of U.S. application Ser. No. 10/603,479, filed Jun. 25, 2003, and entitled Roller Cover Cleaning Device and Method, now abandoned.

BACKGROUND OF THE INVENTION

1. Field of the Invention

The present invention generally relates to cleaning devices for painting accessories, and more specifically relates to an improved cleaning device for roller covers, as well as paint brushes, pans, edgers, etc.

2. Prior Art

Roller covers placed upon roller frames for application of coatings such as paint and stain to surfaces such as walls, doors and trim have been used for many years. Roller covers comprise a sleeve surrounded by a fibrous portion, generally called a nap, for absorbing paint or stain that is rolled onto the surface of the wall, door or trim. Upon completion of an application of paint or stain to a surface, the roller cover must be cleaned of excess paint or stain to prevent the paint or stain from drying within the fibrous nap and rendering the roller cover unusable for future use.

In the past, a common way of cleaning a roller cover was to remove a first amount of excess paint or stain by scraping the nap with a rigid instrument such as a putty knife, screw driver, or a tool having an edge with a curve matching the circumferential curvature of the roller cover. After the first amount of excess paint or stain had been removed, the roller cover was then generally wrung out by hand while being exposed to a diluent such as water, paint thinner or kerosene.

An early example of a device for cleaning a roller cover is a device that is generally referred to as a slinger. A slinger generally has a pair of spring arms for frictionally receiving a roller cover, which arms are connected to a manually actuated spinning mechanism that rotates the spring arms and roller cover, effectively "slinging" the paint or stain from the roller. This type of device is very messy in that the fluid held by the nap of the roller cover is discarded radially during operation of the device.

Other devices have been devised to clean roller covers. U.S. Pat. No. 4,155,230 issued to Lacher discloses a paint roller cover. The hollow center of the cover is closed by appropriate plugs and a cleaning fluid is forced into one end of the casing to flow axially through only the absorbent material and out the other end of the casing. Similarly, U.S. Pat. No. 4,380,478 issued to Cooney discloses an open-ended cylindrical casing sized and shaped to receive a paint roller cover with a plug inserted into one end. The cylindrical casing has a closure cap with a connection for supplying pressurized liquid through the casing and a second aperture closure cap for discharging the liquid. Further, U.S. Pat. No. 6,079,429 issued to Zarich discloses a paint roller cleaner having a generally tubular housing with one open end and a tapered end to join to a faucet coupling adapted to be releasably secured to a water source.

As will be described in greater detail below, the device of the present invention is well suited for cleaning roller covers as well as other painting accessories, simultaneously with, or independently of a roller cover.

SUMMARY OF THE INVENTION

According to the invention there is provided a device for cleaning painting accessories, the device comprising: a housing having an inner cavity configured to receive a painting accessory therein with a diameter sized to create cleansing fluid flow through a nap portion of a roller cover during use in cleaning of a roller cover and an inwardly tapered portion positioned adjacent a tapered end of the roller cover for maintaining the cleansing fluid flow adjacent the tapered end, and having a plurality of outlet apertures positioned adjacent the inwardly tapered portion of the housing; and a spray head for cleaning a roller cover, the head comprising: a fluid supply inlet having a fastener for fastening to a fluid supply; a fluid collection chamber in communication with the fluid supply inlet; a plurality of radially spaced apertures in communication with the fluid collection chamber; a first sealing surface positioned within the radius of the spray apertures sized to substantially seal off an end of the roller cover during use; and a second sealing surface connected positioned surrounding the spray apertures to provide a fluid tight seal between the spray head and a housing for holding the paint roller during use.

Further, according to the invention there is provided a paint roller cleaning kit, the kit comprising: a spray head having a fluid supply inlet with a fastener for fastening to a fluid supply; a fluid collection chamber within the spray head in communication with the fluid supply inlet; threads about an inner perimeter of the spray head; a plurality of spray apertures radially spaced to be adjacent fibrous portions of a roller cover during use; a first sealing surface positioned within the radius of the spray apertures sized to substantially seal off an end of a roller cover during use; a housing threadedly engageable to the spray head and having an inner cavity and a radial array of outlets at an outlet end thereof; a plurality of sleeves nestably receivable in the housing for receiving roller covers of differing diameter, the plurality of sleeves having differing diameters sized to create cleansing fluid flow through the fibrous portion of a roller cover during use and an inwardly tapered portion positioned to be adjacent a tapered second end of the roller cover for maintaining the cleansing fluid flow adjacent the tapered second end.

Still further, according to the invention there is provided a method cleaning a roller cover, the method comprising: collecting cleansing fluid in a collection chamber adjacent a fluid supply inlet; increasing velocity of the cleansing fluid entering into a housing from the collection chamber for cleaning roller a cover by concentrating the cleansing fluid flow through radially spaced spray apertures, the inlet apertures directing the cleansing fluid to a nap portion of a roller cover; guiding the cleansing fluid toward tapered end portions of the roller cover by tapering inner cavity portions of the housing adjacent the tapered end portion of the roller cover; and maintaining cleansing fluid pressure within the housing by restricting cleansing fluid exit from the housing through radially spaced outlet apertures.

Yet further according to the invention there is provided a method for simultaneously cleaning a roller cover and at least one more accessory comprising the steps of: collecting cleansing fluid in a collection chamber adjacent a fluid supply inlet; increasing velocity of the cleansing fluid entering into a housing from the collection chamber for cleaning roller a cover by concentrating the cleansing fluid flow through radially spaced spray apertures, the inlet apertures directing the cleansing fluid to a nap portion of a roller cover; guiding the cleansing fluid toward tapered end portions of the roller cover by tapering inner cavity portions of the housing adjacent the tapered end portion of the roller cover; maintaining cleansing fluid pressure within the housing by restricting cleansing fluid exit from the housing through radially spaced outlet apertures; and directing the cleansing fluid exiting the housing toward the at least one more accessory to clean same simultaneously.

Yet further, according to the invention there is provided a method for cleaning a paint accessory other than a paint roller cover independently comprising the steps of: engaging a spray head comprising a spray head having a fluid supply inlet with a fastener for fastening to a fluid supply; a fluid collection chamber within the spray head in communication with the fluid supply inlet; and a plurality of spray apertures within the spray head and being radially spaced therearound, to a source of cleansing fluid; and directing the cleansing fluid toward, onto, or through the paint accessory to be cleaned.

BRIEF DESCRIPTION OF THE DRAWINGS

FIG. 1 is a longitudinal cross sectional view through the device of the present invention.

FIG. 2 is a longitudinal cross sectional view of a housing of the device.

FIG. 3 is a plan view of the bottom of the housing.

FIG. 4 is a longitudinal cross sectional view through an insert which is receivable in the housing to decrease a diameter thereof.

FIG. 5 is a plan view of the bottom of the insert.

FIG. 11 shows the spray head being used independently to clean a paint accessory, namely a paint brush.

DESCRIPTION OF PREFERRED EMBODIMENT

Figure 6:
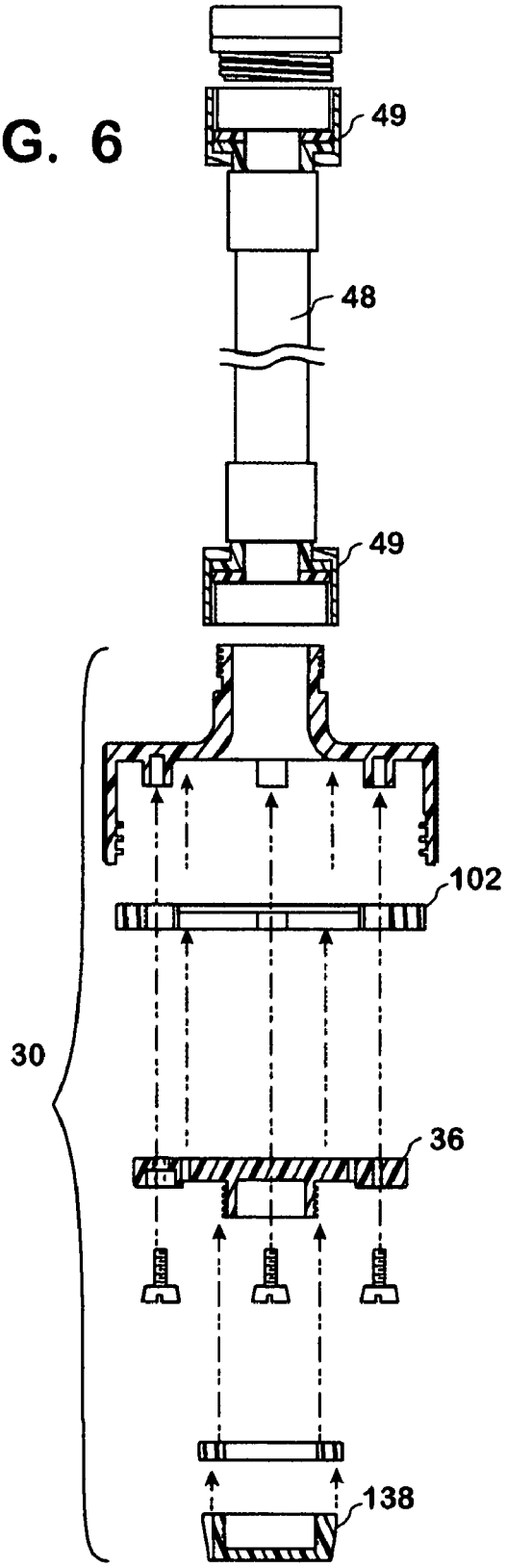
FIG. 6 is an exploded cross sectional view through a spray head of the device.
Figure 7:
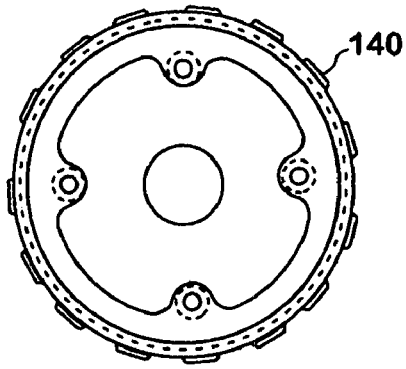
FIG. 7 is a bottom plan view of the spray head.
Figure 12:
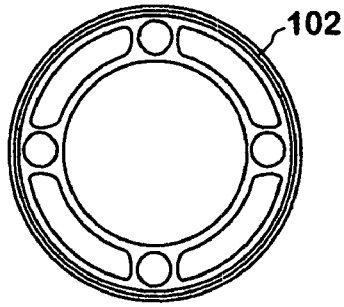
FIG. 12 is a plan view of a bottom of a washer of the device.
Figure 8:
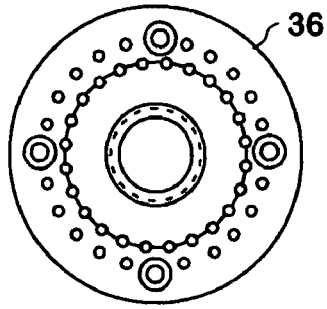
FIG. 8 illustrates a bottom plan view of a spray outlet plate received in the spray head.
Figure 9:
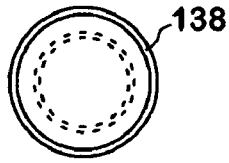
FIG. 9 is a bottom plan view of an inner plug engageable to the outlet plate which keeps water flow directed radially outwardly thereof.
Figure 10:
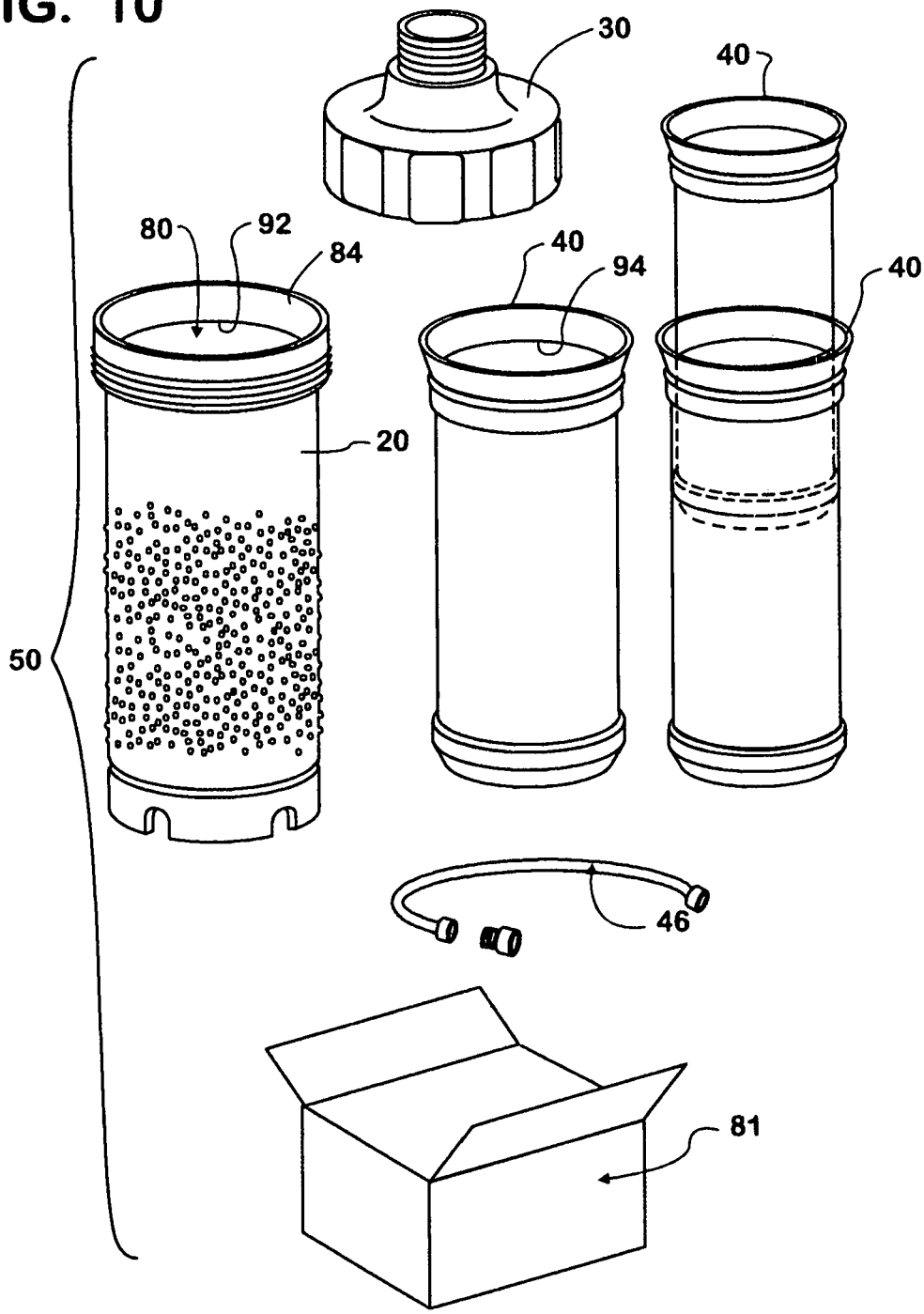
FIG. 10 is an exploded perspective view of a kit including the device showing, the housing, the spray head, a plurality of nestable inserts thereof, a hose use to engage the spray head of the device to a source of diluent, and a box within which the above structures are packaged.

Referring now to the drawings in greater detail there is illustrated therein a paint accessory cleaning device 10 made in accordance with the teachings of the present invention. As shown in FIG. 1 the device 10 generally comprises a housing 20 and a spray head 30 suitably engaged thereto. The device 10 may also further include one or more nestable sleeves 40 receivable within the housing 10, with the device 10 and various ancillary structures also being capable of being provided in the form of a kit 50.

Although the device 10 is primarily functional in efficient cleaning of a roller cover 31, it is equally well suited for simultaneously or independently cleaning other paint accessories 33, such as a brush 33, used in an exemplary fashion to represent such other paint accessories 33.

Accordingly, all uses will be detailed below, with emphasis placed on the cleaning of a roller cover 31 typically having tapered ends 35, though this should not, in any light, be construed as limiting.

The spray head or inlet manifold 30 incorporates a fluid supply inlet 32, a collection chamber 34, spray apertures 36, a first sealing surface 38, a second sealing surface 42 and threads 43 about the inner periphery 44 of the spray head 30 that are sized and shaped to engage coacting threads 45 on an open end 47 of the housing 20.

The fluid supply inlet 32 includes a threaded retainer 46 for connecting the device 10 to a fluid supply or faucet (not shown) via a hose 48 having appropriate connectors 49 on each end thereof, the hose 48 being preferably 1 inch in diameter with about a ½ inch interior diameter. The device 10 may also optionally include other suitable retainers or adapters, known in the art, for connection of the device 10 to various types of fastening schemes common in fluid conduit connections.

The collection chamber 34 collects fluid 52 entering the device 10 via the fluid supply inlet 32. Fluid 52 then exits spray apertures 36 of the spray head 30, increasing the velocity of the fluid 52 entering the housing 20 to improve cleaning of various paint accessories 31, 33, as defined above.

The inlet or spray apertures 36 are radially spaced to lie adjacent the fibrous or nap portion 56 of a roller cover 31 when the device 10 is used to clean such roller 31. A first grouping 60 of spray apertures 36 is radially spaced preferably from about 1⅞ inches to about 2⅛ inches apart and the apertures 36 are preferably sized from about 1/16 inch to about 3/32 inch in diameter and direct fluid to inner areas of the nap portion 56.

A second grouping 62 of spray apertures 36 surrounds the first grouping 60 of spray apertures 36 to provide increased flow of fluid 52 to outer areas of the nap portion 56.

It has been shown through extensive testing that such placement and sizing of the spray apertures 36 provides superior results in cleaning the nap portion 56 of paint rollers 31. It is also contemplated, in one embodiment, that the spray apertures 36 may be angled inwardly toward a center point of their radial spacing. It is contemplated that the preferred inward angularity of the spray apertures 36 would range from 0° to about 22½° from a vertical orientation. It is even further contemplated that the spray apertures 36 may be divergently angled with respect to one another. Thus, orientation of the spray apertures 36 should not be construed as limiting.

The first concentric sealing surface 38 of the spray head 30 is positioned radially inwardly of the radius of the first grouping 60 of spray apertures 36 for directing flow of fluid 52 toward the nap portion 56 of the roller cover 31 during use in cleaning same.

The second concentric sealing surface 42 of the spray head 30 surrounds the first group 60 of spray apertures 36 and is positioned to provide a fluid tight seal between the housing 20 and the spray head 30 when the housing 20 and the spray head 30 are threadedly engaged, as desired in a preferred embodiment.

The housing 20 is preferably made of plastic about ⅛ inch thick and incorporates an inner cavity 80 for receiving roller covers 31 therein, a plurality of outlet apertures 82, an open neck portion 84, an inwardly tapered bottom area 86, spaced apart feet 88 and a sealing surface 89 against which an inner wall 100 of the paint roller 31 abuts. The inner cavity 80 has a diameter sized primarily to create cleansing flow of fluid 52 through the nap portion 56 of a roller cover 31 when used to clean such roller cover 31. A length of the inner cavity 80 is such that one tapered end 35 of a roller cover 31 seals against the first sealing surface 38 of the spray head 30 and a tapered second end 35 of the roller cover 31 seats in a circumferential groove 89 in a bottom wall 90 of the inner cavity 80, defined between the tapered bottom area 86 and the sealing surface 89.

The plurality of outlet apertures 82 communicate with the inner cavity 80 of the housing 20, and are radially spaced to be adjacent nap portion 56 of roller cover 31 during use in cleaning same. The inwardly tapered portion 86 is positioned to be adjacent the tapered second end 35 of the roller cover 31 for maintaining the cleansing flow of fluid 52 adjacent the tapered second end 35. The feet 88 may be formed integrally with the housing 20 to assist in standing the housing 20 in an upright position and providing clearance for fluid 52 exiting the housing 20 during use.

Roller covers 31 commonly come in several different standard diameters such as 2 inches, 2¼ inches and 3 inches. In order to accommodate the variations in diameter, the device 10 may also include accessory, nestable spacer sleeves 40 which are preferably made of a plastic and are of decreasing diameter for nested insertion into the inner cavity 80 of the housing 20 when cleaning a smaller diameter roller cover 31 to maintain the cleansing flow of fluid 52 through the nap portion 56 of the roller cover 31.

It will be understood that the device 10 with accessory structures defined above could be sold in a kit 50, the kit being made into a package 81.

The device 10 of the claimed invention operates in a manner where pressurized cleansing fluid 52 such as water, is fed into the device 10 through the fluid supply inlet 32. The cleansing fluid 52 enters the collection chamber 34 defined by an opening 34 within a thick washer 102, from where it exits through the groups 60 and 62 of inlet or spray apertures 36 into the inner cavity 80 of the housing 20. The spray apertures 36 perform the dual function of increasing the velocity of the cleansing fluid 52 entering the housing 20 and directing the cleansing flow of fluid 52 evenly to all areas of the nap portion 56 of the roller cover 31 to accomplish thorough cleaning. The close proximity of the nap portion 56 to an inner wall 92 of the housing 20 or 94 of accessory sleeve(s) 40 forces the cleansing fluid 52 through the nap portion 56 of the roller cover 31, cleaning excess material such as water based paint or varnish from the nap portion 56 when water 52 is the fluid 52 used therewith. Once the cleansing fluid 54 reaches the bottom wall 90 of the inner cavity 80, it exits the housing 20 via outlet apertures 82.

It will be understood that pressurized paint thinners, varnish removers, etc. could also be used with the device 10.

The claimed invention also comprises a method of cleaning a roller cover 31 and/or other accessory 33, accomplished using the device 10.

When cleaning a roller cover 31 only, the device 10 first collects the cleansing fluid 52 in the collection chamber 34 so that the cleansing fluid 52 can be directed into the housing 20 through the spray apertures 36. The velocity of the cleansing fluid 52 is then increased by concentrating the flow rate of the cleansing fluid 52 entering the device 10 into directed streams through the use of the spray apertures 36. The spray apertures 36 also achieve the goal of pointedly directing the cleansing fluid 52 streams toward the nap portion 56, of the roller cover 31.

The internal configuration of the device 10 then guides the removed coating material and cleansing fluid 52 toward the bottom or second tapered end portion 35 of the roller cover 31 by providing the inwardly tapered portion 86 of the housing 20 positioned adjacent the tapered end portion 35 of the roller cover 31. During testing of the device 10 it was determined that the inwardly tapered portion 86 increased roller cover cleaning efficiency.

The device 10 also accomplishes the step of maintaining cleansing fluid 52 pressure within the housing 20 by restricting outflow of the cleansing fluid 52 through the outlet apertures 82.

Restricting outflow of the cleansing fluid 52 from the housing 20 results in improved cleaning efficiency measured in the number of gallons or liters of cleansing fluid 52 required to properly clean a roller cover 31 using a roller cover cleaning device 10 of the type claimed.

It will further be understood that use of the device 10 is not restricted to cleaning of paint rollers 31 alone.

In this respect, since the cleaning fluid 52 exiting the outlet apertures 82 of the housing 20 is maintained pressurized, the device 10 can be used to simultaneously clean an accessory 33, such as the brush 33, by directing the outflow against the accessory 33, rather than merely standing the device on its feet or legs 88, as best illustrated in FIG. 1.

Alternatively, as illustrated in FIG. 11, the spray head 30 can be used independently of the housing 20, for cleaning such accessories 33, independently of cleaning a roller cover 31.

Although the invention has been described by reference to some embodiments it is not intended that the device 10 be limited thereby, but that modifications thereof are intended to be included as falling within the broad scope and spirit of the foregoing disclosure, the following claims and the appended drawings.

I claim:

1. A device for cleaning painting accessories, the device comprising:

a housing having an inner cavity configured to receive a painting accessory therein with a diameter sized to create cleansing fluid flow through a nap portion of a roller cover during use in cleaning of a roller cover and an inwardly tapered portion positioned adjacent a tapered end of the roller cover for maintaining the cleansing fluid flow adjacent the tapered end, and having a plurality of outlet apertures positioned adjacent the inwardly tapered portion of the housing, and further including a plurality of nestable sleeves sized and shaped to fit within the inner cavity of the housing; and a spray head for cleaning a roller cover, the head comprising:

a fluid supply inlet having a fastener for fastening to a fluid supply;

a fluid collection chamber in communication with the fluid supply inlet;

a plurality of radially spaced apertures in communication with the fluid collection chamber;

a first sealing surface positioned within the radius of the spray apertures sized to substantially seal off an end of the roller cover during use; and a second sealing surface connected positioned surrounding the spray apertures to provide a fluid tight seal between the spray head and a housing for holding the paint roller during use.

2. The device of claim 1 wherein the inner cavity of the housing has a length such that a first end of the roller cover seals against the first sealing surface of the spray head and a tapered second end of the roller cover abuts a bottom wall of the inner cavity during use.

3. The device of claim 1 wherein the housing includes at least one foot portion for standing the housing in an upright position to provide clearance for fluid exiting the housing during use.

* * * * *